US010020554B2

(12) United States Patent
Parekh et al.

(10) Patent No.: US 10,020,554 B2
(45) Date of Patent: Jul. 10, 2018

(54) WAVEGUIDE DEVICE WITH SEPTUM FEATURES

(71) Applicant: ViaSat, Inc., Carlsbad, CA (US)

(72) Inventors: Sharad V. Parekh, Frisco, TX (US); Dominic Q. Nguyen, Irvine, CA (US)

(73) Assignee: ViaSat, Inc., Carlsbad, CA (US)

( * ) Notice: Subject to any disclaimer, the term of this patent is extended or adjusted under 35 U.S.C. 154(b) by 308 days.

(21) Appl. No.: 14/948,179

(22) Filed: Nov. 20, 2015

(65) Prior Publication Data

US 2017/0047661 A1 Feb. 16, 2017

Related U.S. Application Data

(60) Provisional application No. 62/205,572, filed on Aug. 14, 2015.

(51) Int. Cl.

| | |
|---|---|
| ***H01P 1/161*** | (2006.01) |
| ***H01P 3/12*** | (2006.01) |
| ***H01Q 19/02*** | (2006.01) |
| ***H01Q 19/13*** | (2006.01) |
| ***H01Q 19/17*** | (2006.01) |
| ***H01P 1/17*** | (2006.01) |

(52) U.S. Cl.

CPC ..... *H01P 3/12* (2013.01); *H01P 1/173* (2013.01); *H01Q 19/028* (2013.01); *H01Q 19/132* (2013.01); *H01Q 19/17* (2013.01)

(58) Field of Classification Search

CPC ..... H01P 3/12; H01P 1/173; H01Q 9/028; H01Q 19/132; H01Q 19/17

USPC ..... 333/21 A

See application file for complete search history.

(56) References Cited

U.S. PATENT DOCUMENTS

| | | | | |
|---|---|---|---|---|
| 4,122,406 | A * | 10/1978 | Salzberg | H01P 1/173 333/113 |
| 4,126,835 | A | 11/1978 | Gould | |
| 4,356,459 | A | 10/1982 | Gould et al. | |
| 4,492,938 | A | 1/1985 | Young | |
| 5,061,037 | A | 10/1991 | Wong et al. | |
| 5,305,001 | A | 4/1994 | Wong et al. | |
| 6,507,323 | B1 | 1/2003 | West | |

(Continued)

FOREIGN PATENT DOCUMENTS

| | | |
|---|---|---|
| CN | 203225337 U | 10/2013 |
| DE | 4437595 A1 | 5/1995 |
| JP | 2007329741 A | 12/2007 |
| KR | 101228014 B1 | 2/2013 |
| WO | WO 2014108203 A1 | 7/2014 |

OTHER PUBLICATIONS

Chang, T. H., *Dual-function Circular Polarization Converter For Microwave/Plasma Processing Systems*, Review of Scientific Instruments, vol. 70, No. 2, Feb. 1999, 5 pages.

(Continued)

*Primary Examiner* — Robert J Pascal
*Assistant Examiner* — Kimberly Glenn
(74) *Attorney, Agent, or Firm* — Holland & Hart LLP

(57) ABSTRACT

Methods, systems, and devices are described that include one or more septum features to improve performance of a waveguide device. In particular, the septum features may be utilized within a polarizer section of a polarizer device such as a septum polarizers. The septum feature(s) may be a ridge. When a plurality of septum features are employed, the location, size, shape and spacing may vary according to a particular design.

25 Claims, 10 Drawing Sheets

(56) References Cited

U.S. PATENT DOCUMENTS

| | | | | |
|---|---|---|---|---|
| 6,522,215 | B2 * | 2/2003 | Enokuma | H01P 1/17 333/135 |
| 6,661,390 | B2 | 12/2003 | Gau et al. | |
| 6,861,997 | B2 | 3/2005 | Mahon | |
| 7,132,907 | B2 | 11/2006 | Chambelin et al. | |
| 8,077,103 | B1 | 12/2011 | Acosta et al. | |
| 8,354,969 | B2 | 1/2013 | Lin et al. | |
| 8,525,616 | B1 | 9/2013 | Shaw et al. | |
| 9,000,861 | B2 | 4/2015 | Ado et al. | |
| 2002/0171596 | A1 | 11/2002 | Em et al. | |
| 2014/0254976 | A1 | 9/2014 | Thomson et al. | |

OTHER PUBLICATIONS

Galuscak, Rastislav, *Advanced Design of Reflector Based Antennas*, Jun. 2011, Czech Technical University in Prague, 19 pages.

Galuscak, et al., *Compact Circular/Linear Polarization Dual-Band Prime-Focus Feed For Space Communication*, International Journal of Antennas and Propagation vol. 2012, Article ID 860951, 5 pages.

Wade, *Septum Polarizers and Feeds*, W1GHZ Copyright 2003, 20 pgs.

Ihmels, et al., "Field Theory Design of a Corrugated Septum OMT", IEEE Microwave Symposium Digest, vol. 2, Jun. 1993, pp. 909-912.

Chou, et al., "*Numerical Investigation on the Performance of a Septum Polarizer by Inserting Additional Stubs For its Applications in the CP Horn Antennas*", Microwave and Optical Technology Letters, vol. 51, No. 1, Jan. 2009, pp. 269-273.

Non final office action dated Jan. 9, 2018, "Waveguide Device With Sidewall Features", U.S. Appl. No. 14/940,333, 13 pgs.

Anders, "*Waveguide Device With Sidewall Features*", U.S. Appl. No. 14/940,333, filed Nov. 13, 2015.

Elliott, "*Two-Mode Waveguide for Equal Mode Velocities*", IEEE Transactions on Microwave Theory and Techniques, vol. MTT-16, No. 5, May 1968, 5 pgs.

* cited by examiner

WAVEGUIDE DEVICE WITH SEPTUM FEATURES

CROSS REFERENCES

The present Application for Patent claims priority to U.S. Provisional Patent Application No. 62/205,572 by Parekh, et al. , entitled, "WAVEGUIDE DEVICE WITH SEPTUM FEATURES," filed Aug. 14, 2015, assigned to the assignee hereof and expressly incorporated by reference herein.

BACKGROUND

The present disclosure relates to wireless communications systems, and more particularly to waveguide devices that may be employed in such systems.

By way of example, a waveguide device may be used for uni-directional (transmit or receive) or bi-directional (transmit and receive) of polarized waves. The waveguide device may include a polarizer that converts between polarized (e.g., linearly polarized, circularly polarized, etc.) waves used for transmission and/or reception via a common waveguide and signals associated with basis polarizations of the polarizer in a divided waveguide section. The polarizer may be a passive polarization transducer. A septum polarizer is one such passive polarization transducer that can operate in a bi-directional manner. A septum polarizer includes a septum which forms a boundary between first and second divided waveguides associated with the basis polarizations. Septum polarizers may provide favorable isolation between the divided waveguides and may be used for concurrent transmission and reception of polarized signals.

Septum polarizer performance has become challenged by increases in bandwidth requirements for various applications. For example, in some applications a septum polarizer may be configured to convert the polarization of signals at more than one carrier signal frequency, in which case the operational bandwidth of the septum polarizer may be relatively large. Conventional designs may have relatively sharp performance drop-off at the band edges. Accordingly, such designs may have little margin and thus require very tight manufacturing tolerances in order to operate over the desired frequency band, which may be difficult to maintain and expensive.

SUMMARY

Methods, systems and devices are described for enhancing performance of a septum polarizer of a waveguide device using one or more septum features. A waveguide device may include one or more septum features such as a ridge. The waveguide device may include one or more ridges on one or more surfaces of the septum of a polarizer section. The septum may be a stepped septum and one or more surfaces of the septum may include multiple ridges. Additionally or alternatively, a ridge may include multiple ridge sections. The ridges may have a longitudinal axis along a central axis of the polarizer section, which may be a direction of signal propagation between a common waveguide section and a divided waveguide section.

The foregoing has outlined rather broadly the features and technical advantages of examples according to the disclosure in order that the detailed description that follows may be better understood. Additional features and advantages will be described hereinafter. The conception and specific examples disclosed may be readily utilized as a basis for modifying or designing other structures for carrying out the same purposes of the present disclosure. Such equivalent constructions do not depart from the scope of the appended claims. Characteristics of the concepts disclosed herein, both their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the present invention may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Aspects described herein include a septum feature, such as a ridge, on one or more surfaces of a septum of a waveguide device including a polarizer section. For example, the waveguide device may include one or more ridges on one or both of a first surface or a second surface of the septum. Various parameters of each ridge (e.g., number, location, shape, size, spacing, etc.) may be determined according to a particular design implementation. Each ridge thus adds degrees of freedom to the design of a waveguide device, which may help with performance optimization and may increase the achievable performance. The septum features may be configured to lower the waveguide cutoff values and/or alter the propagation constant, which can provide improvements to the performance and/or design flexibility of the waveguide device. For example, the addition of one or more ridges may allow designs to increase bandwidth margins, which may improve robustness to dimensional variations that may result from various manufacturing processes. This may be beneficial, for example, in relatively high volume applications (e.g., where molding or casting may be employed) to achieve increased yields. Furthermore, an increased bandwidth margin may, for instance, improve the ability to design, manufacture, and/or operate a septum polarizer configured to convert the polarization of signals at more than one carrier signal frequency.

This description provides examples, and is not intended to limit the scope, applicability or configuration of embodiments of the principles described herein. Rather, the ensuing description will provide those skilled in the art with an enabling description for implementing embodiments of the principles described herein. Various changes may be made in the function and arrangement of elements.

Thus, various embodiments may omit, substitute, or add various procedures or components as appropriate. For instance, it should be appreciated that the methods may be performed in an order different than that described, and that various steps may be added, omitted or combined. Also, aspects and elements described with respect to certain embodiments may be combined in various other embodiments. It should also be appreciated that the following systems, methods, devices, and software may individually or collectively be components of a larger system, wherein other procedures may take precedence over or otherwise modify their application.

Figure 1A:
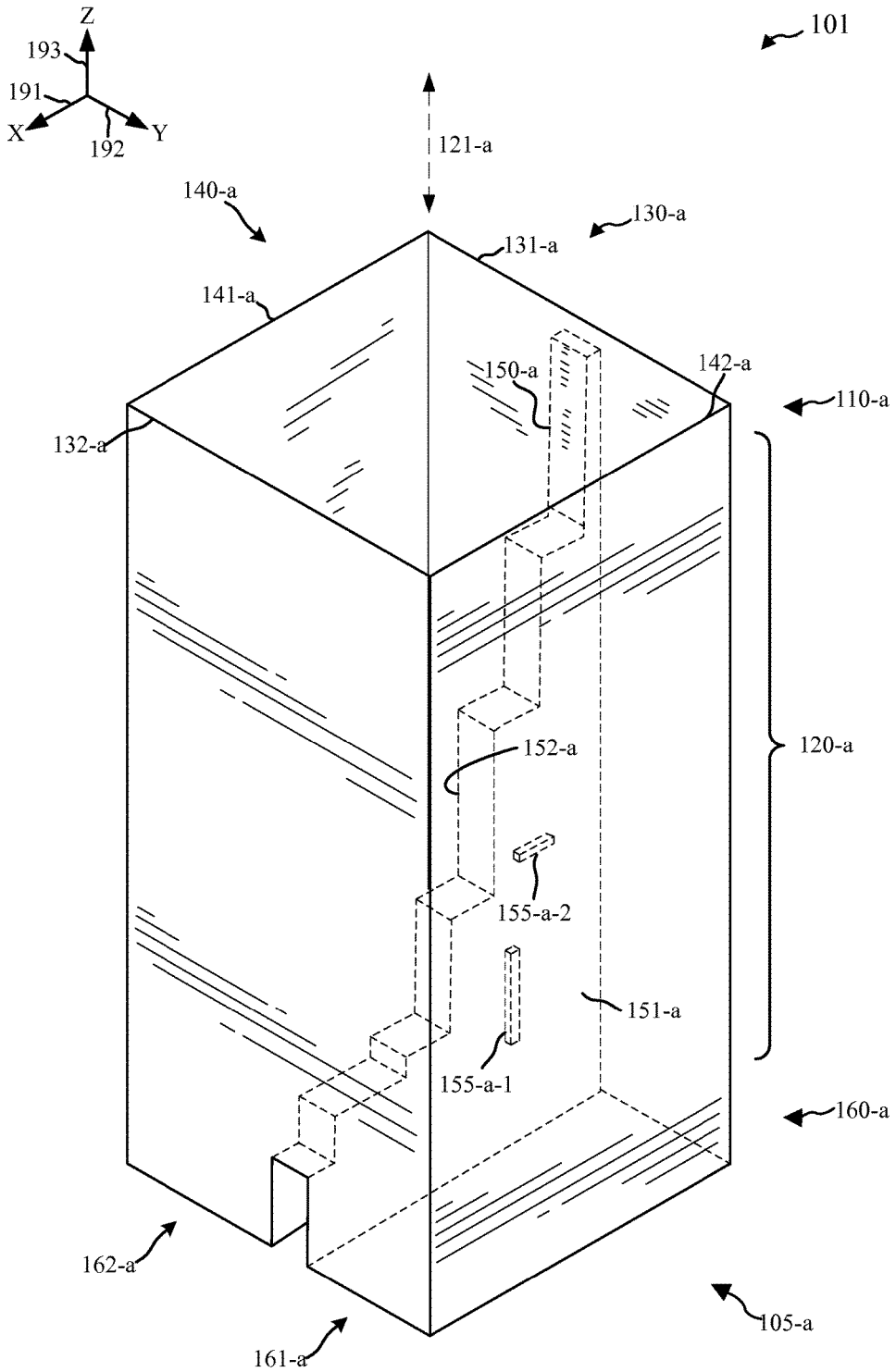
FIGS. 1A and 1B shows views of an example waveguide device with septum features in accordance with various aspects of the present disclosure.
Figure 1B:
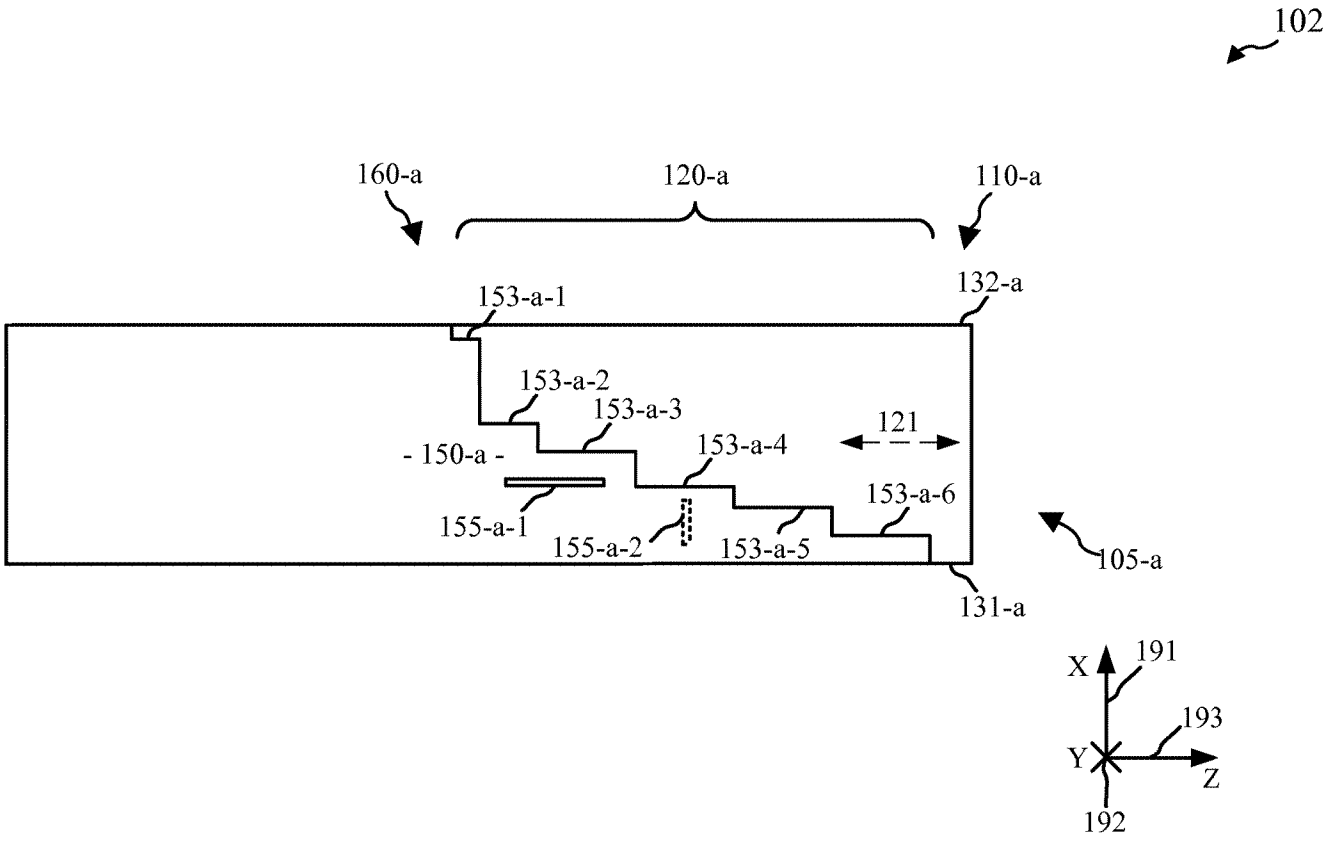

FIGS. 1A and 1B shows views of an example waveguide device 105-*a* with septum features in accordance with various aspects of the present disclosure. For reference, the waveguide device 105-*a* is shown in FIGS. 1A and 1B relative to an X-axis 191, a Y-axis 192, and a Z-axis 193. The waveguide device 105-*a* may include a common waveguide section 110-*a*, a divided waveguide section 160-*a*, and a polarizer section 120-*a* coupled between the common waveguide section 110-*a* and the divided waveguide section 160-*a*.

The waveguide device 105-*a* can have a central axis 121-*a*, which is along the Z-axis 193. Although the central axis 121-*a* is represented above the waveguide device 105-*a* for clarity, the central axis 121-*a* can be interpreted as passing through the volume of the waveguide device 105-*a* including the polarizer section 120-*a* in the direction shown. The polarizer section 120-*a* can include a first set of opposing sidewalls 130-*a* consisting of a first sidewall 131-*a* and a second sidewall 132-*a* of the first set of opposing sidewalls 130-*a*. The polarizer section 120-*a* can also include a second set of opposing sidewalls 140-*a* consisting of a first sidewall 141-*a* and a second sidewall 142-*a* of the second set of opposing sidewalls 140-*a*.

The polarizer section 120-*a* may combine/divide signals travelling between the common waveguide section 110-*a* and the divided waveguide section 160-*a* along the central axis 121-*a*. The polarizer section 120-*a* can convert a signal between one or more polarization states in the common waveguide section 110-*a* and two signal components in the individual divided waveguides 161-*a*, 162-*a* that correspond to orthogonal basis polarizations (e.g., left hand circularly polarized (LHCP) signals, right hand circularly polarized (RHCP) signals, etc.).

A septum 150-*a* may be disposed in the polarizer section 120-*a*, extending between the first sidewall 131-*a* and the second sidewall 132-*a* of the first set of opposing sidewalls 130-*a*. The septum 150-*a* can also have a first surface 151-*a* and a second surface 152-*a* (on the back side of septum 150-*a* in perspective view 101 of FIG. 1A). In some examples, one or both of the first surface 151-*a* and the second surface 152-*a* of the septum 150-*a* can be planar, and in some examples the first surface 151-*a* and the second surface 152-*a* can both be parallel to the central axis 121-*a* (e.g., in the x-z plane of perspective view 101). The thickness of the septum 150-*a* between the first surface 151-*a* and the second surface 152-*a* can vary from embodiment to embodiment. The thickness of the septum 150-*a* may be significantly smaller than the dimensions of a cavity of the polarizer section 120-*a*. In some examples, the height (e.g., along the Y-axis 192) or width (e.g., along the X-axis 191) of a cross-section of the polarizer section 120-*a* can be at least ten times greater than the thickness of the septum 150-*a*. The septum 150-*a* can have a uniform or non-uniform thickness (e.g., tapered).

The septum 150-*a* provides a boundary between a first divided waveguide 161-*a* and a second divided waveguide 162-*a* and has different effects on different modes of signal propagation in the polarizer section 120-*a* based on their orientation relative to the septum 150-*a*. For example, an RHCP or LHCP signal propagating in the negative Z-axis direction in common waveguide section 110-*a* may be understood as having a $TE_{01}$ mode component signal with its E-field along X-axis 191 and a $TE_{10}$ mode component signal with its E-field along Y-axis 192 having equal amplitudes but offset in phase. As the signal propagates through the polarizer section 120-*a*, the septum 150-*a* acts as a power divider to the $TE_{10}$ mode component signal. However, to the $TE_{01}$ mode component signal, the polarizer section 120-*a* with septum 150-*a* acts like a ridge loaded waveguide with a short aligned with the strongest E-field portion. The ridge-loading effect of the septum 150-*a* effectively increases the electrical length of the polarizer section 120-*a* for the $TE_{01}$ mode component signal, which facilitates phase change and conversion of the $TE_{01}$ mode component signal relative to the $TE_{10}$ mode component signal. As the signal reaches the divided waveguide section 160-*a*, the converted $TE_{01}$ mode component signal may be additively combined with the $TE_{10}$ mode component signal on one side of the septum 150-*a*, while cancelling the $TE_{10}$ mode component signal on the other.

For example, as a received signal wave having LHCP propagates from the common waveguide section 110-*a* through the polarizer section 120-*a*, the $TE_{01}$ mode component signal may, after conversion in the polarizer section 120-*a*, additively combine with the $TE_{10}$ mode component signal on the side of the septum 150-*a* coupled with the first divided waveguide 161-*a*, while cancelling on the side of the septum 150-*a* coupled with the second divided waveguide 162-*a*. Similarly, a signal wave having RHCP may have $TE_{01}$ and $TE_{10}$ mode component signals that additively combine on the side of the septum 150-*a* coupled with the second divided waveguide 162-*a* and cancel each other on the side of the septum 150-*a* coupled with the first divided waveguide 161-*a*. Thus, the first and second divided waveguides 161-*a*, 162-*a* may be excited by orthogonal basis polarizations of polarized waves incident on the common waveguide, and may be isolated from each other. In a transmission mode, excitations of the first and second divided waveguides 161-*a*, 162-*a* (e.g., $TE_{10}$ mode signals) may result in corresponding LHCP and RHCP waves, respectively, emitted from the common waveguide section 110-*a*.

The polarizer section 120-*a* can be configured in a manner that facilitates simultaneous dual-polarized operation. For example, from a signal dividing perspective, the polarizer section 120-*a* can be interpreted as receiving a signal having a combined polarization in the common waveguide section, and substantially transferring energy corresponding to a first basis polarization (e.g., LHCP) of the signal to the first divided waveguide 161-*a*, and substantially transferring energy corresponding to a second basis polarization (e.g., RHCP) of the signal to the second divided waveguide 162-*a*.

From a signal combining perspective, the polarizer section 120-*a* can substantially transfer energy from the first divided waveguide 161-*a* to the common waveguide section 110-*a* as a wave having the first basis polarization, and also substantially transfer energy from the second divided waveguide 162-*a* to the common waveguide section 110-*a* as a wave having the second basis polarization such that a combined signal in the common waveguide section 110-*a* is transmitted as a wave having a combined polarization.

The waveguide device 105-*a* may be used to transmit or receive linearly polarized signals having a desired polarization tilt angle at the common waveguide section 110-*a* by changing the relative phase of component signals transmitted or received via the first divided waveguide 161-*a* and second divided waveguide 162-*a*. For example, two equal-amplitude components of a signal may be suitably phase shifted and sent separately to the first divided waveguide 161-*a* and the second divided waveguide 162-*a* of the waveguide device 105-*a*, where they are converted to an LHCP wave and an RHCP wave at the respective phases by the polarizer section 120-*a*. When emitted from the common waveguide section 110-*a*, the LHCP and RHCP waves combine to produce a linearly polarized wave having an orientation at a tilt angle related to the phase shift introduced into the two components of the transmitted signal. The transmitted wave is therefore linearly polarized and can be aligned with a polarization axis of a communication system. In some instances, the waveguide device 105-*a* may operate in a transmission mode for a first polarization (e.g., LHCP, first linear polarization) while operating in a reception mode for a second, orthogonal polarization.

As illustrated in the present example, the common waveguide section 110-*a* has a rectangular (e.g., square) cross sectional opening, shown here as an opening in the x-y plane of the perspective view 101. In other examples, the common waveguide section 110-*a* can have a different cross sectional shape or shapes that provide suitable opening and/or suitable coupling between the common waveguide section 110-*a* and the polarizer section 120-*a*, such as a trapezoid, a rhombus, a polygon, a circle, an oval, an ellipse, or any other suitable shape. In some examples, the common waveguide section 110-*a* may be coupled with an antenna element, such as an antenna horn element.

As illustrated in the present example, the first sidewall 131-*a* and the second sidewall 132-*a* of the first set of opposing sidewalls 130-*a* are parallel, planar surfaces, and on opposite sides of the central axis 121-*a*. The first sidewall 141-*a* and the second sidewall 142-*a* of the second set of opposing sidewalls 140-*a* are also parallel, planar surfaces, and on opposite sides of the central axis 121-*a*. Furthermore, as illustrated in the present example, each of the first sidewall 141-*a* and the second sidewall 142-*a* of the second set of opposing sidewalls are orthogonal with each of the first sidewall 131-*a* and the second sidewall 132-*a* of the first set of opposing sidewalls 130-*a*. In this manner, some examples of the waveguide device 105-*a* may have a polarizer section 120-*a* having a volume generally characterized by a rectangular prism. In other examples, the first sidewall 131-*a* and the second sidewall 132-*a* of the first set of opposing sidewalls may be non-parallel, and/or the first sidewall 141-*a* and the second sidewall 142-*a* of the second set of opposing sidewalls 140-*a* may be non-parallel. Furthermore, in various examples of the waveguide device 105-*a*, either of the first sidewall 131-*a* or the second sidewall 132-*a* of the first set of opposing sidewalls 130-*a* may be non-orthogonal with either of the first sidewall 141-*a* or the second sidewall 142-*a* of the second set of opposing sidewalls 140-*a*. Therefore, some examples of the waveguide device 105-*a* may have a polarizer section 120-*a* having a volume generally characterized by a rhombohedral prism, a trapezoidal prism, and the like. In other examples of the waveguide device 105-*a*, the polarizer section 120-*a* may have additional opposing or non-opposing sidewalls, and in such examples the polarizer section 120-*a* may have a volume generally characterized by a polygonal prism, a pyramidal frustum, and the like.

As illustrated in the present example, the distance between the second set of opposing sidewalls 140-*a* does not change through the polarizer section 120-*a*. In other embodiments, this distance may change. For example, the second set of opposing sidewalls 140-*a* may include one or more transitions (e.g., stepped, smooth, etc.) within the polarizer section 120-*a* that reduce the distance of the second set of opposing sidewalls 140-*a* for a least a portion of the polarizer section. For example, the distance between the second set of opposing sidewalls 140-*a* may be a first distance within the common waveguide section 110-*a*, transition to a second distance less than the first distance within a portion of the polarizer section 120-*a* adjacent the common waveguide section 110-*a*, and then transition back to the first distance within a portion of the polarizer section 120-*a* adjacent the divided waveguide section 160-*a*.

In some aspects, the septum 150-*a* includes one or more ridges 155-*a*. Specifically, as illustrated in the present example, the septum 150-*a* has a first ridge 155-*a*-1 projecting from the first surface 151-*a* of the septum 150-*a* (i.e., projecting from the septum 150-*a* in a positive direction along the Y-axis 192). Optionally, the septum 150-*a* may have a second ridge 155-*a*-2 projecting from the first surface 151-*a* (i.e., projecting from the septum 150-*a* in a positive direction along the Y-axis 192), or projecting from the second surface 152-*a* (i.e., projecting from the septum 150-*a* in a negative direction along the Y-axis 192). Therefore the septum 150-*a* can have ridges 155-*a* on both the first surface 151-*a* and the second surface 152-*a* of the septum 150-*a*, and/or multiple ridges 155-*a* on the same surface.

Each ridge 155-*a* can have a width along a direction between the first sidewall 131-*a* and the second sidewall 132-*a* of the first set of opposing sidewalls 130-*a* (e.g., along the X-axis 191). Each ridge 155-*a* can also have a height along a direction between the first sidewall 141-*a* and the second sidewall 142-*a* of the second set of opposing sidewalls 140-*a* (e.g., along the Y-axis 192), measured from the face upon which the ridge is located (e.g., the first surface 151-*a* or the second surface 152-*a* of the septum 150-*a*). Each ridge 155-*a* can also have a length in a direction of the central axis 121-*a* (e.g., along the Z-axis 193). Each ridge 155-*a* can have a longitudinal axis, where the longitudinal axis is directed over the longest dimension of the ridge (e.g., a ridge having a longitudinal axis along the length direction of the ridge when the length dimension of the ridge is greater than the width dimension of the ridge and the height dimension of the ridge, such as illustrated by the first ridge 155-*a*-1). In some examples, a one or more ridges 155-*a* can have a longitudinal axis in the direction of the central axis 121-*a* of the waveguide device 105-*a* (i.e., the length dimension of the ridge is greater than the width dimension of the ridge and the height dimension of the ridge, such as illustrated by the first ridge 155-*a*-1). Optionally, the waveguide device 105-*a* may have one or more ridges 155-*a* that have a longitudinal axis in a direction non-parallel with central axis 121-*a* (e.g., the second ridge 155-*a*-2 of FIG. 1A).

Although multiple ridges 155-*a* are shown in the illustrated example, it should be understood that a single ridge 155-*a* may be formed on one or each of the first surface 151-*a* or the second surface 152-*a* of the septum 150-*a*. Furthermore, the number of ridges 155-*a* on the first surface 151-*a* of the septum 150-*a* (e.g., zero, one or more) need not be equal to the number (e.g., zero, one or more) of ridges 155-*a* on the second surface 152-*a* of the septum 150-*a*, nor do ridges 155-*a* need to be of the same size or shape.

Additional aspects of the waveguide device 105-*a* of FIG. 1A will be described with reference to FIG. 1B, which shows a cross-sectional view 102 of the waveguide device 105-*a*.

FIG. 1B may illustrate, for example, a cross section of the waveguide device 105-*a* in a plane orthogonal to the Y-axis 192, thereby showing the waveguide device 105-*a* in the X-Z plane.

The septum 150-*a* may include multiple stepped surfaces 153-*a*-1, 153-*a*-2, 153-*a*-3, 153-*a*-4, 153-*a*-5 and 153-*a*-6, where each of the stepped surfaces 153-*a* are perpendicular to the first surface 151-*a* and the second surface 152-*a* of the septum 150 and parallel to the central axis 121-*a* (e.g., each stepped surface is in the Y-Z plane).

As noted above, the ridges 155-*a*-1 and 155-*a*-2 may be located on the septum 150-*a* within the polarizer section 120-*a*. As previously described, the first ridge 155-*a*-1, having a longitudinal axis in the same direction as the central axis 121-*a*, may protrude from the first surface 151-*a* of the septum 150-*a*. Optionally, the waveguide device 105-*a* may also include the second ridge 155-*a*-2, having a longitudinal axis in a different direction, such as in a direction between the first sidewall 131-*a* the second sidewall 132-*a* of the first pair of opposing sidewalls 130-*a* (e.g., along the X-axis 191). As previously described, the second ridge 155-*a*-2 may protrude from the first surface 151-*a* or the second surface 152-*a* of the septum 150-*a*. It should be understood that this arrangement is only an example and the ridge(s) 155 may be located in various positions or configurations along the septum 150-*a*.

For example, one or more ridges 155-*a* may be located adjacent to an edge of the septum surface (e.g., adjacent to a stepped surface 153-*a* or to sidewall 131-*b*, etc.)

The waveguide device 105-*a* illustrated in FIGS. 1A and 1B may be an example of a dual-band device, where a dual-band signal is characterized by operation using two signal carrier frequencies. In such case, a substantial increase in performance may be achieved in a lower frequency band of the dual band signal (which may otherwise be relatively sensitive to manufacturing tolerances) using one or more ridges 155-*a* on the septum 150-*a*, while some increase in performance in a higher frequency band of the dual-band signal also may be achieved. Such increase(s) in performance may allow a desired performance objective (e.g., axial ratio, port isolation, bandwidths, return loss, higher order mode (e.g., $TE_{11}$ mode) suppression, etc.) to be achievable across the desired frequency band(s).

For example, polarization characteristics of the waveguide device 105-*a* may be measured by axial ratio performance. In some cases, a desired objective for performance may be an axial ratio of less than one decibel (dB), which corresponds to a cross-polarization discrimination (XPD) of less than 24.8 dB. The axial ratio performance is generally limited by the quadrature phase relationship achievable in the common waveguide section 110-*a* between the $TE_{10}$ and $TE_{01}$ orthogonal modes (e.g., the quadrature phase error between these modes in the common waveguide section 110-*a*). In the polarizer section 120-*a*, the propagation of each of these two modes is different (e.g., the $TE_{10}$ mode is mostly unaffected by the septum). The waveguide cutoff values for these modes limit the axial ratio performance that is achievable.

The mode corresponding to the septum acting as an E-plane ridge (e.g., the $TE_{01}$ mode) may have a reduced lower cutoff frequency than the orthogonal mode (e.g., $TE_{10}$ mode). The septum feature(s) described herein may create an artificial boundary condition (e.g., a surface impedance or perturbation) along the septum 150-*a*, which may alter the propagation constant in one or more portions of the polarizer section 120-*a* for the $TE_{10}$ mode. The different propagation constant created by the septum feature(s) may alter the propagation characteristics for the $TE_{10}$ mode without altering the propagation characteristics for the $TE_{01}$ mode. For example, the septum feature(s) may increase the conducting perimeter boundary length for the $TE_{10}$ mode to an extent similar to ridge loading provided by the septum to the $TE_{01}$ mode, thus equalizing the propagation constants for the $TE_{10}$ and $TE_{01}$ modes. As a result, the septum feature(s) provide an additional degree of freedom for achieving the desired phase relationship between the $TE_{10}$ and $TE_{01}$ modes. Using the additional degree of freedom, performance at lower and/or higher operational frequencies can be improved, such that performance objectives such as a desired operational bandwidth, axial ratio (e.g., less than 1 dB), and/or cross-polarization discrimination may be achieved. For example, in dual-band operation, the axial ratio and cross-polarization discrimination may be improved in one or both of the lower frequency band or the higher frequency band. This also may provide increased bandwidth margins to allow for manufacturing tolerances. Although described with reference to dual-band operation, the septum feature(s) described herein also may be employed for the design of single-band or multi-band waveguide devices to improve the performance in the single bandwidth (e.g., higher broadband performance, etc.).

Figure 2A:
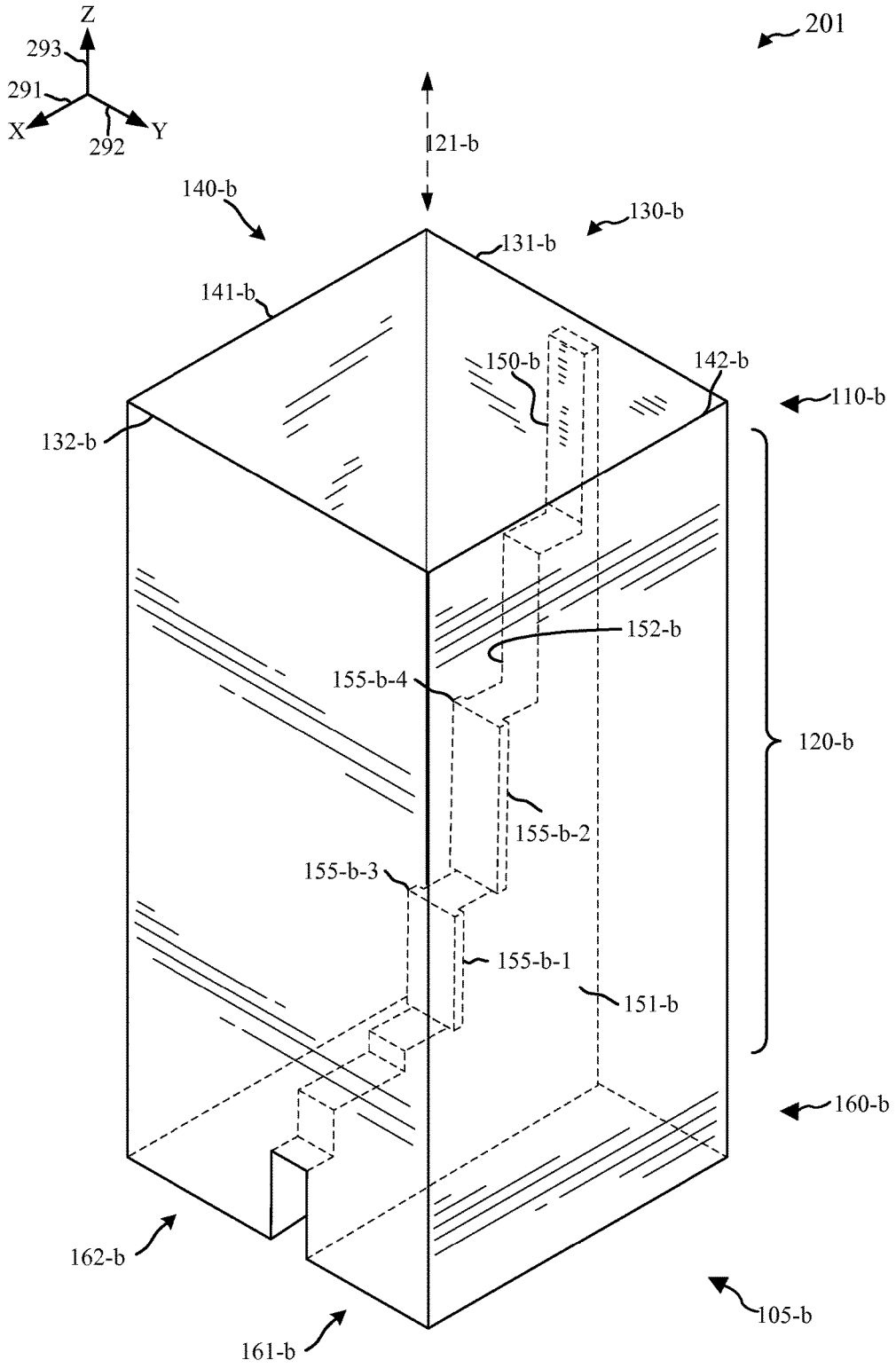
FIGS. 2A and 2B show views of an example waveguide device with septum features adjacent to stepped surfaces of the septum in accordance with various aspects of the present disclosure.
Figure 2B:
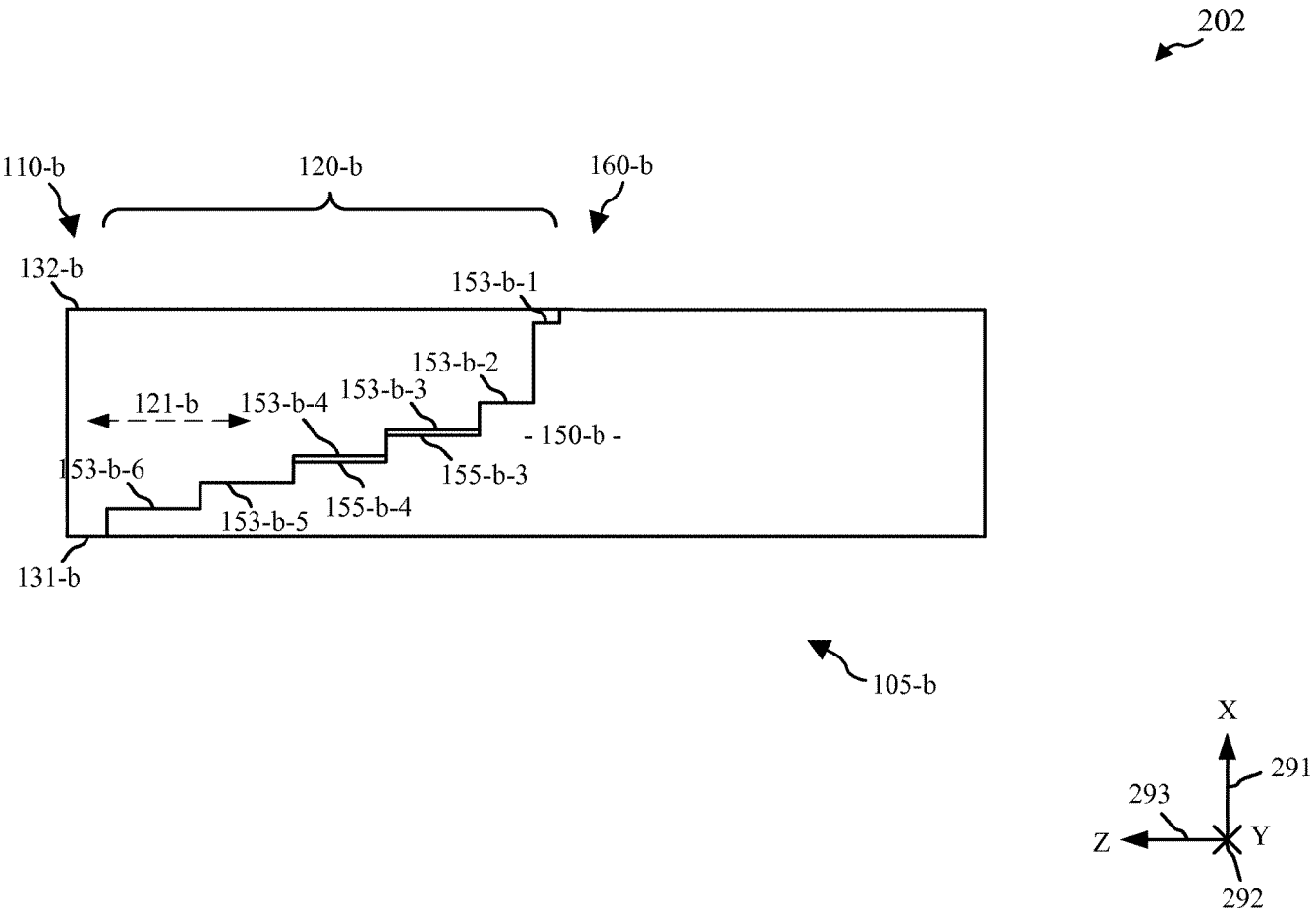

FIGS. 2A and 2B show views of an example waveguide device 105-*b* with septum features adjacent to stepped surfaces of the septum in accordance with various aspects of the present disclosure. FIG. 2A shows a perspective view 201 relative to an X-axis 291, a Y-axis 292, and a Z-axis 293. The waveguide device 105-*b* may include a common waveguide section 110-*b*, a divided waveguide section 160-*b*, and a polarizer section 120-*b* coupled between the common waveguide section 110-*b* and the divided waveguide section 160-*b*.

The polarizer section 120-*b* can have a central axis 121-*b*, which is along a direction between the common waveguide section 110-*b* and the divided waveguide section 160-*b* (e.g., along the Z-axis 293). The polarizer section 120-*b* can include a first set of opposing sidewalls 130-*b* consisting of a first sidewall 131-*b* and second sidewalls 132-*b* of the first set of opposing sidewalls 130-*b*. The polarizer section 120-*b* can also include a second set of opposing sidewalls 140-*b* consisting of a first sidewall 141-*b* and a second sidewall 142-*b* of the second set of opposing sidewalls 140-*b*. A septum 150-*b* may be disposed in the polarizer section 120-*b*, extending between the first sidewall 131-*b* and the second sidewall 132-*b* of the first set of opposing sidewalls 130-*b*. The septum 150-*b* can also have a first surface 151-*b* and a second surface 152-*b* (on the back side of septum 150-*b* in perspective view 201), each extending between the first sidewall 131-*b* and the second sidewall 132-*b* of the first set of opposing sidewalls 130-*b*. The divided waveguide section 160-*b* can have a first divided waveguide 161-*b* associated with a first basis polarization and a second divided waveguide 162-*b* associated with a second basis polarization.

It will be readily understood by one skilled in the related arts that various aspects of the waveguide device 105-*b* can share any of the aspects described with respect to the waveguide device 105-*a* illustrated in FIGS. 1A and 1B, such as those aspects relating to the common waveguide section 110-*a*, the polarizer section 120-*a*, and the divided waveguide section 160-*a*. Those descriptions are equally applicable to the waveguide device 105-*b* and are therefore omitted here for brevity.

The septum 150-*b* may include multiple stepped surfaces 153-*b*-1, 153-*b*-2, 153-*b*-3, 153-*b*-4, 153-*b*-5 and 153-*b*-6, where each of the stepped surfaces are perpendicular to the first surface 151-*b* and the second surface 152-*b* of the septum 150-*b* and parallel to the central axis 121-*b* (e.g., each stepped surface is in the Y-Z plane).

As illustrated in the present example, the septum 150-*b* includes a plurality of ridges 155-*b* and can have ridges 155-*b* on both the first surface 151-*b* and the second surface 152-*b*. Specifically, the septum 150-*b* has a first ridge 155-*b*-1 and a second ridge 155-*b*-2 projecting from the first surface 151-*b* (e.g., projecting in a positive direction along the Y-axis 292), as well as third ridge 155-*b*-3 and fourth ridge 155-*b*-4 projecting from the second surface 152-*b* (e.g., projecting in a negative direction along the Y-axis 292). In the example waveguide device 105-*b* , ridges 155-*b* are adjacent to stepped surfaces 153-*b* of the septum 150-*b*.

In some examples, one or more ridges 155-*b* can be aligned with one another along the central axis 121-*b*, where the aligned ridges 155-*b* may be on the same side or on opposite sides of the septum 150-*b*. For example, as shown in perspective view 201, the first ridge 155-*b*-1 and the third ridge 155-*b*-3 can be aligned with each other along the central axis 121-*b*. Said another way, the first ridge 155-*b*-1 and the third ridge 155-*b*-3 have the same extent along the central axis 121-*b*.

In waveguide device 105-*b*, ridges 155-*b*-1, 155-*b*-2, 155-*b*-3, and 155-*b*-4 have their longitudinal axis in the direction of the central axis 121-*b* of the waveguide device 105-*b*. As illustrated in the present example, each ridge 155-*b* can have the same height and width as the other ridges 155-*b*. In other examples, the height and width of each ridge 155-*b* may be different from one or more other ridges 155-*b*. As illustrated in the present example, two ridges 155-*b* may have the same length (e.g., the first ridge 155-*b*-1 and the third ridge 155-*b*-3), and/or two ridges may have different lengths (e.g., the first ridge 155-*b*-1 and the second ridge 155-*b*-2). Said more generally, septum 150-*b* may have ridges 155-*b* of the same or different sizes on each surface, and ridges 155-*b* adjacent to the same step of the septum 150-*b* on opposite surfaces of the septum may have the same or a different size.

Although multiple ridges 155-*b* are shown in the illustrated example, it should be understood that a single ridge 155-*b* may be formed on one or each of the first surface 151-*b* or the second surface 152-*b* of the septum 150-*b*. Furthermore, the number of ridges 155 on the first surface 151-*b* of the septum 150-*b* (e.g., zero, one or more) need not be equal to the number (e.g., zero, one or more) of ridges 155-*b* on the second surface 152-*b* of the septum 150-*b*, nor do ridges 155-*b* need to be of the same size or shape.

Additional aspects of the waveguide device 105-*b* will be described with reference to FIG. 2B, which shows a cross-sectional view 202 of the waveguide device 105-*b*. FIG. 2B may illustrate, for example, a cross section of the waveguide device 105-*b* in a plane orthogonal to the Y-axis 292, thereby showing the waveguide device 105-*b* in the X-Z plane.

As noted above, the ridges 155-*b* may be located on the septum 150-*b* within the polarizer section 120-*b*. In the case of a stepped septum 150-*b*, ridges 155-*b* may be adjacent to a stepped surface 153-*b*, such as the third ridge 155-*b*-3 being adjacent to stepped surface 153-*b*-3 and the fourth ridge 155-*b*-4 being adjacent to stepped surface 153-*b*-4 as illustrated in the present example. As used herein, the term "adjacent" can refer to a ridge 155-*b* being next to or alongside a stepped surface 153-*b*, or a surface of a ridge 155-*b* being coplanar with, tangent to, or intersecting at a line with a stepped surface 153-*b*.

It should be understood that this arrangement is only an example and that the location(s) of the ridge(s) 155-*b* may be varied across the septum 150-*b* (e.g., adjacent to only one of the stepped sections, adjacent to all of the stepped sections, and/or adjacent to a curved section (not shown) of the septum 150-*b*). In some cases, locating the ridge(s) 150-*b* near a middle portion of the polarizer section 120-*b*, such as approximately half-way between the common waveguide section 110-*b* and the divided waveguide section 160-*b* may provide a greater effect. Additionally or alternatively, the ridge(s) 155-*b* may be located within an end portion of the polarizer section 120-*b*, closer to either the common waveguide section 110-*b* or the divided waveguide section 160-*b*.

In some examples, a ridge 155-*b* may have a length along its longitudinal axis extending for the length of a respective stepped surface 153-*b* of the septum 150-*b*. For instance, as illustrated in the present example, the third ridge 155-*b*-3 has a length along the longitudinal axis (e.g., along the Z-axis 293) that extends the length of stepped surface 153-*b*-3. Said another way, the third ridge 155-*b*-3 can be aligned with stepped surface 153-*b*-3 along the central axis 121-*b*. In other examples, a ridge 155-*b* may not extend along the entire length of a stepped surface 153-*b*. Therefore, in some examples a ridge 155-*b* may extend only a portion of the stepped surface 153-*b*, which in some examples may include one extent in the direction of the central axis of the stepped surface 153-*b* or the other. In still other examples, a ridge 155-*b* may extend farther along the Z-direction than a stepped surface 153-*b*, and therefore may extend into a middle portion of the septum 150-*b*, or extend beyond the septum 150-*b* into a cavity of the polarizer section 120-*b*.

As shown in FIGS. 1A, 1B, 2A and 2B, each ridge 155 has a cross-sectional shape taken in a direction orthogonal to the longitudinal axis of the ridge 155 that is rectangular (e.g., square). In other examples, each ridge 155 may have another cross-sectional shape (e.g., semi-circular, semi-elliptical, triangular or polygonal, etc.) and some ridges 155 may have a different shape than other ridges.

Figure 3A:
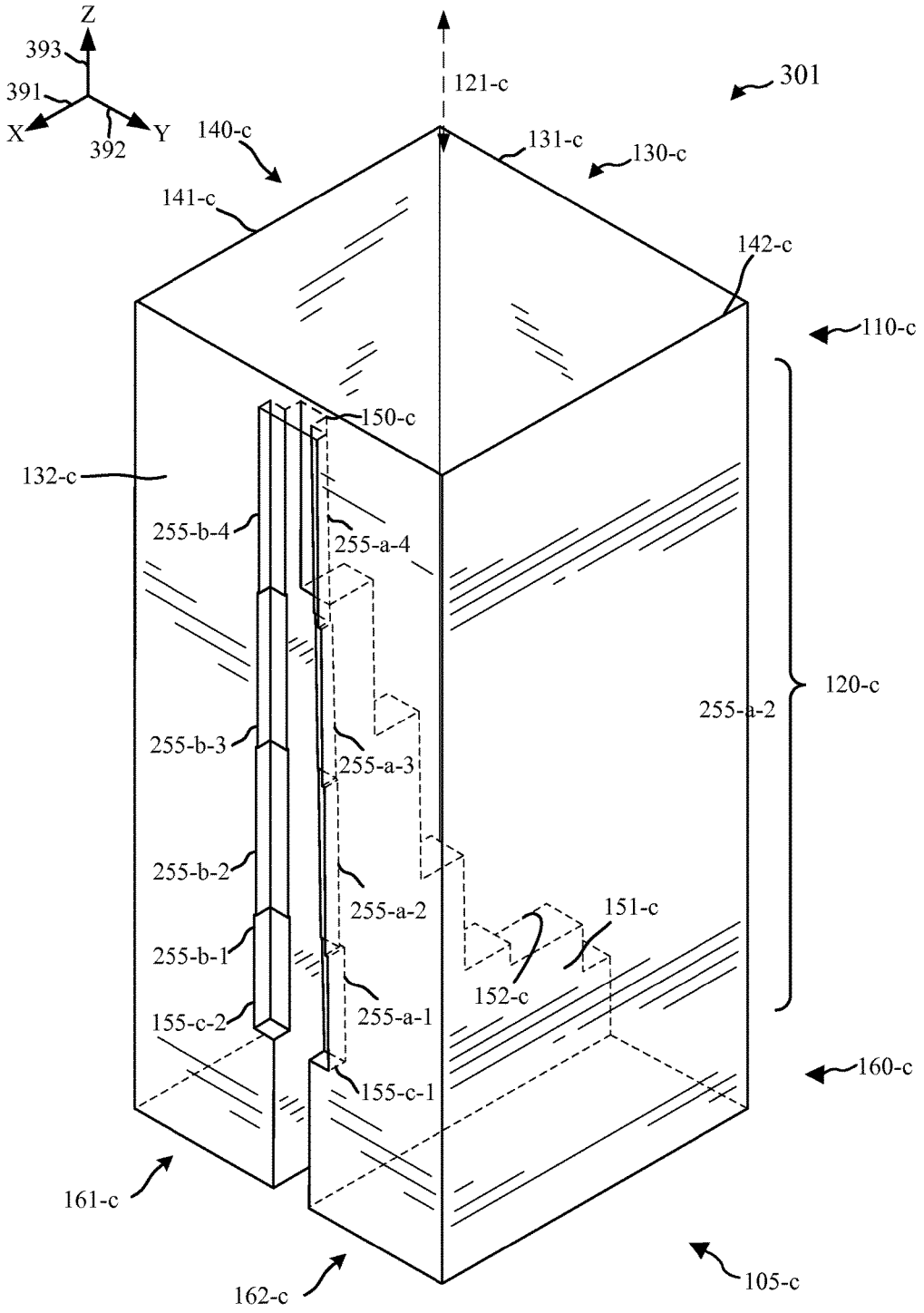
FIGS. 3A-3C show views of an example waveguide device with septum features adjacent to a sidewall in accordance with various aspects of the present disclosure.
Figure 3B:
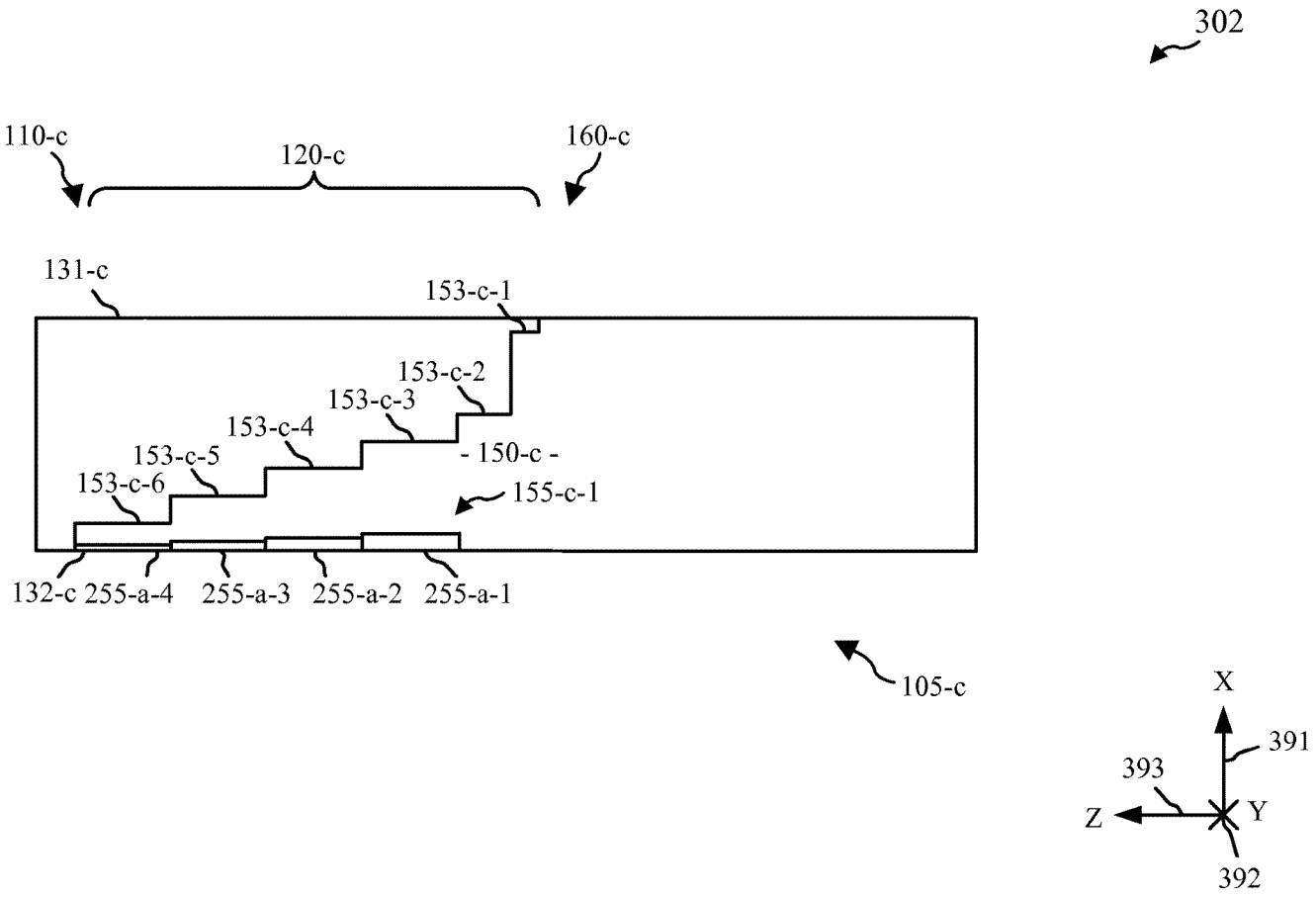
Figure 3C:
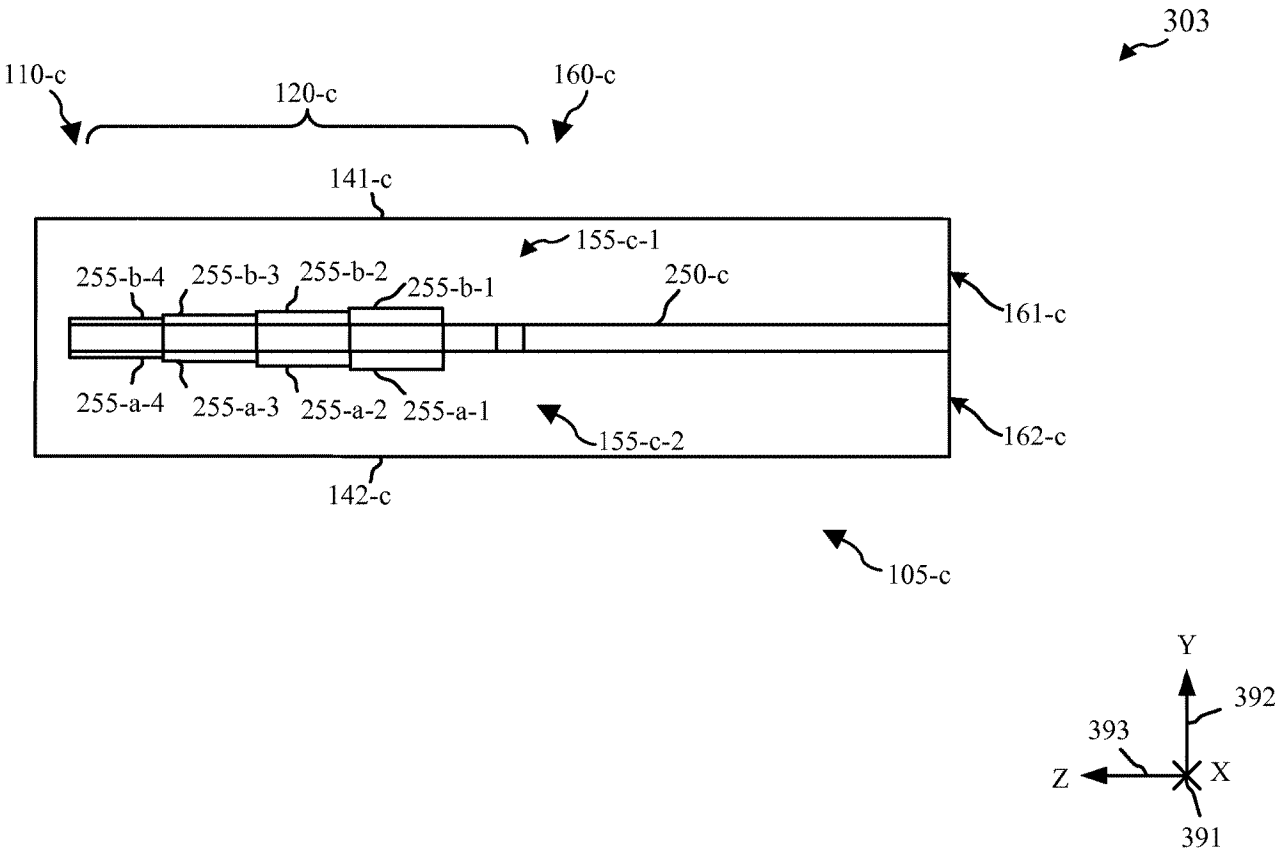

FIGS. 3A-3C show views of an example waveguide device 105-*c* with septum features adjacent to a sidewall in accordance with various aspects of the present disclosure. FIG. 2A shows a perspective view 301 of waveguide device 105-*c* and, for reference, is shown relative to an X-axis 391, a Y-axis 392, and a Z-axis 393. The waveguide device 105-*c* may include a common waveguide section 110-*c*, a divided waveguide section 160-*c*, and a polarizer section 120-*c* coupled between the common waveguide section 110-*c* and the divided waveguide section 160-*c*.

The polarizer section 120-*c* can have a central axis 121-*c*, which is along a direction between the common waveguide section 110-*c* and the divided waveguide section 160-*c* (e.g., along the Z-axis 393). The polarizer section 120-*c* can include a first set of opposing sidewalls 130-*c* consisting of a first sidewall 131-*c* and second sidewall 132-*c*. The polarizer section 120-*c* can also include a second set of opposing sidewalls 140-*c* consisting of a first sidewall 141-*c* and a second sidewall 142-*c* of the second set of opposing sidewalls 140-*c*. A septum 150-*c* may be disposed in the polarizer section 120-*c*, extending between the first sidewall 131-*c* and the second sidewall 132-*c* of the first set of opposing sidewalls 130-*c*. The septum 150-*c* can also have a first surface 151-*c* and a second surface 152-*c* (on the back side of septum 150-*c* in perspective view 301), each extending between the first sidewall 131-*c* and the second sidewall 132-*c* of the first set of opposing sidewalls 130-*c*. The divided waveguide section 160-*c* can have a first divided waveguide 161-*c* associated with a first basis polarization and a second divided waveguide 162-*c* associated with a second basis polarization.

It will be readily understood by one skilled in the related arts that various aspects of the waveguide device 105-*c* can share any of the aspects described with respect to the waveguide devices 105 illustrated in FIGS. 1A, 1B, 2A, and 2B, such as those aspects relating to the common waveguide sections 110, the polarizer sections 120, and the divided waveguide sections 160. The corresponding descriptions for these features are equally applicable to the waveguide device 105-*c*, and are therefore omitted here for brevity.

As illustrated in the present example, the septum 150-*c* includes two ridges 155. Specifically, the septum 150-*c* has a first ridge 155-*c*-1 projecting from the first surface 151-*c* (e.g., projecting in a positive direction along the Y-axis 392), as well as second ridge 155-*c*-2 projecting from the second surface 152-*c* (e.g., in a negative direction along the Y-axis 392). As shown in FIG. 3A, a ridge 155 can be coincident with both the septum 150-*c* and a sidewall from the first set of opposing sidewalls 130-*c*. Specifically, the first ridge 155-*c*-1 can be coincident with the first surface 151-*c* of the septum 150-1, and also coincident with the second sidewall 132-*c*. The second ridge 155-*c*-2 can be coincident with the second surface 152-*c* of the septum 150-*c*, and also coincident with the second sidewall 132-*c*.

As illustrated in the present example, a ridge 155 has a plurality of ridge sections 255. Specifically, the first ridge 155-*c*-1 can comprise a first ridge section 255-*a*-1, a second ridge section 255-*a*-2, a third ridge section 255-*a*-3, and a fourth ridge section 255-*a*-4. The second ridge 155-*c*-2 can comprise a first ridge section 255-*b*-1, a second ridge section 255-*b*-2, a third ridge section 255-*b*-3, a fourth ridge section 255-*b*-4 and a fifth ridge section 255-*b*-5. Each of the ridge sections 255 can have a cross-sectional shape taken orthogonal to the central axis which is uniform through the ridge section 255. Furthermore, the size or cross-sectional shape of each ridge section 255 can be different from the size or cross-sectional shape of another ridge section 255.

Additional aspects of the waveguide device 105-*c* will be described with reference to FIGS. 3B and 3C, which show cross-sectional views of the waveguide device 105-*c*. Cross-sectional view 302 of FIG. 3B may illustrate, for example, a cross section of the waveguide device 105-*c* in a plane orthogonal to the Y-axis 392, thereby showing the waveguide device 105-*c* in the X-Z plane. FIG. 3C may illustrate, for example, a cross sectional view 303 of the waveguide device 105-*c* in a plane orthogonal to the X-axis 391, thereby showing the waveguide device 105-*c* in the Y-Z plane.

As noted above, a ridge 155-*c* may be located on the septum 150-*c* within the polarizer section 120-*c*, and be adjacent to a sidewall of the first set of opposing walls, such as the first ridge 155-*c*-1 being adjacent to the second sidewall 132-*c* as illustrated in the present example. As used herein, the term "adjacent" can refer to a ridge 155-*c* being coincident with or alongside the second sidewall 132-*c*, and/or a surface of a ridge 155-*c* intersecting with the second sidewall 132-*c*.

The septum 150-*c* may include multiple stepped surfaces 153-*c*-1, 153-*c*-2, 153-*c*-3, 153-*c*-4, 153-*c*-5 and 153-*c*-6, where each of the stepped surfaces are perpendicular to the first surface 151-*c* and the second surface 152-*c* of the septum 150-*c* and parallel to the central axis 121-*c* (e.g., each stepped surface is in the Y-Z plane).

Each ridge section 255 may or may not be aligned with a stepped surface 153. For example, the first ridge section 255-*a*-1 of the first ridge 155-*c*-1 has the same extent in the direction of the central axis 121-*c* as the third stepped surface 153-*c*-3 of the septum 150-*c*. Although each ridge section 255 is shown as aligning in the direction of the central axis 121-*c* as a stepped surface 153-*c*, in other examples of a polarizer section 120-*c*, a ridge 155-*c* may have ridge sections 255 that do not align with a stepped surface 153-*c*.

Each ridge section 255 can have a width in a direction between opposing faces of the first set of opposing faces, such as the direction between the first sidewall 131-*c* and the second sidewall 132-*c* (e.g., along the X-axis 391). Each ridge section 255 can have a height in a direction between opposing faces of the second set of opposing sidewalls 140-*c*, such as the direction between the first sidewall 141-*c* and the second sidewall 142-*c* of the first set of opposing sidewalls 140-*c* (e.g., along the Y-axis 392). Each ridge section 255 can also have a length in a direction of the central axis 121-*c* (e.g., along the Z-axis 393). As illustrated in the present example, ridges 155-*c* have a length that is greater than half the length of the septum 150-*c* in the direction of the central axis 121-*c*. As illustrated in the present example, each ridge section 255 has a different width and height from adjacent ridge sections 255. In various other examples, only the width or height may vary between adjacent ridge sections 255.

As shown in FIGS. 3A-3C, each ridge section 255 has a cross-sectional shape taken in a direction orthogonal to the central axis that is rectangular (e.g., square). In other examples, each ridge section may have a cross-sectional shape that is different from another ridge section, which may further include such shapes as a semi-circular, semi-elliptical, triangular or polygonal.

FIGS. 1A, 1B, 2A, 2B, and 3A-3C illustrate common waveguide sections 110 as having a non-zero length in the direction of the central axis 121. However, the common waveguide section 110 of a waveguide device 105 can be construed as a planar section of the waveguide device 105 coincident with the polarizer section 120 and/or septum 150. In various examples, an antenna device can be coupled to the common waveguide section 110 in any manner appropriate to transmit a signal to or from the polarizer section 120.

Although six stepped surfaces 153 are shown in FIGS. 1A, 1B, 2A, 2B, and 3A-3C, it should be understood that other numbers of stepped surfaces 153 may be employed for a septum 150. Further, it should be understood that other configurations of the septum 150 (e.g., curved, sloped, combination curved and stepped, combination sloped and stepped, etc.) may be used depending on the particular design implementation.

The first sidewall 131 of the polarizer sections 120 of waveguide devices 105 can be understood as a single sidewall extending between the second set of opposing sidewalls 140-*a* or as multiple sidewalls separated by septum 150. The multiple sidewalls may be coplanar, or, in other examples, may not be coplanar, and may have a different distance of separation (e.g., along the X-axis 191, 291, or 391) from the second sidewall 132 of the first pair of opposing sidewalls 130.

In waveguide devices 105 shown in FIGS. 1A, 1B, 2A, 2B, and 3A-3C, the polarizer sections 120 can have a cross-sectional width measured between the first sidewall 131 and the second sidewall 132 of the first set of opposing sidewalls 130 and a cross-sectional height measured between the first sidewall 141 and the second sidewall 142 of the second set of opposing sidewalls 140. In some examples of the waveguide devices 105, the height and/or width of a ridge 155 or ridge section 255 may have a particular relationship with a cross-sectional dimension of the polarizer section 120. For instance, the dimensions of a ridge 155 or ridge section 255 may be significantly smaller than the dimensions of a cavity of a polarizer section 120, and such a relationship can provide particular desirable performance characteristics of the waveguide device 105. For instance, in some examples, the cross-sectional width or height of the polarizer section 120 can be at least five times greater than at least one of the height or the width of the ridge 155 or the ridge section 255.

In some examples, the cross-sectional width or height of the polarizer section 120 can be at least ten times greater than at least one of the height or the width of the ridge 155 or the ridge section 255.

In waveguide devices 105 shown in FIGS. 1A, 1B, 2A, 2B, and 3A-3C one or more ridges 155 may be formed monolithically with a septum 150. Said another way, a septum 150 and one or more ridges 155 may be formed from a single volume of material or workpiece. In some examples, at least a portion of each of a septum 150, one or more ridges 155, a first sidewall 131 and a second sidewall 132 of a first set of opposing sidewalls 130, and a first sidewall 141 and a second sidewall 142 of a second set of opposing sidewalls 140 may be formed monolithically, and/or from a single workpiece. For instance, the aforementioned components may be manufactured by such additive processes as molding, casting, 3-d printing, and the like. Additionally or alternatively, the aforementioned components may be manufactured by such subtractive processes as machining, grinding, polishing, electron-discharge machining, water jet cutting, laser cutting, and the like. Additionally or alternatively, the material of one or more ridges 155 may be different from a material of one or more of a septum 150, a first sidewall 131 and a second sidewall 132 of a first set of opposing sidewalls 130, and a first sidewall 141 and a second sidewall 142 of a second set of opposing sidewalls 140.

In some examples, any of the aforementioned components may be formed individually, and then coupled together using such means as gluing, soldering, brazing, welding, and/or mechanical fastening. In some examples, such coupling may provide a degree of electrical, electromagnetic, thermal, and/or other form of isolation between a ridge 155 and a septum 150. In some examples one or more of the aforementioned components may be formed from a volume of material that is subsequently coated. As a non-limiting example, for instance, the volume a septum may be formed from a first material, and the volume of a ridge may be formed from a second material. In various examples the septum and the ridge can be coupled with each other, and then coated with a third material such as a metal foil, a dielectric coating, or any other suitable coating which coats at least a portion of the coupled septum and ridge. Coatings may be applied by any suitable process, such as spraying, powder coating, vapor depositing, anodizing, immersion, chemical conversion, and the like.

Figure 4:
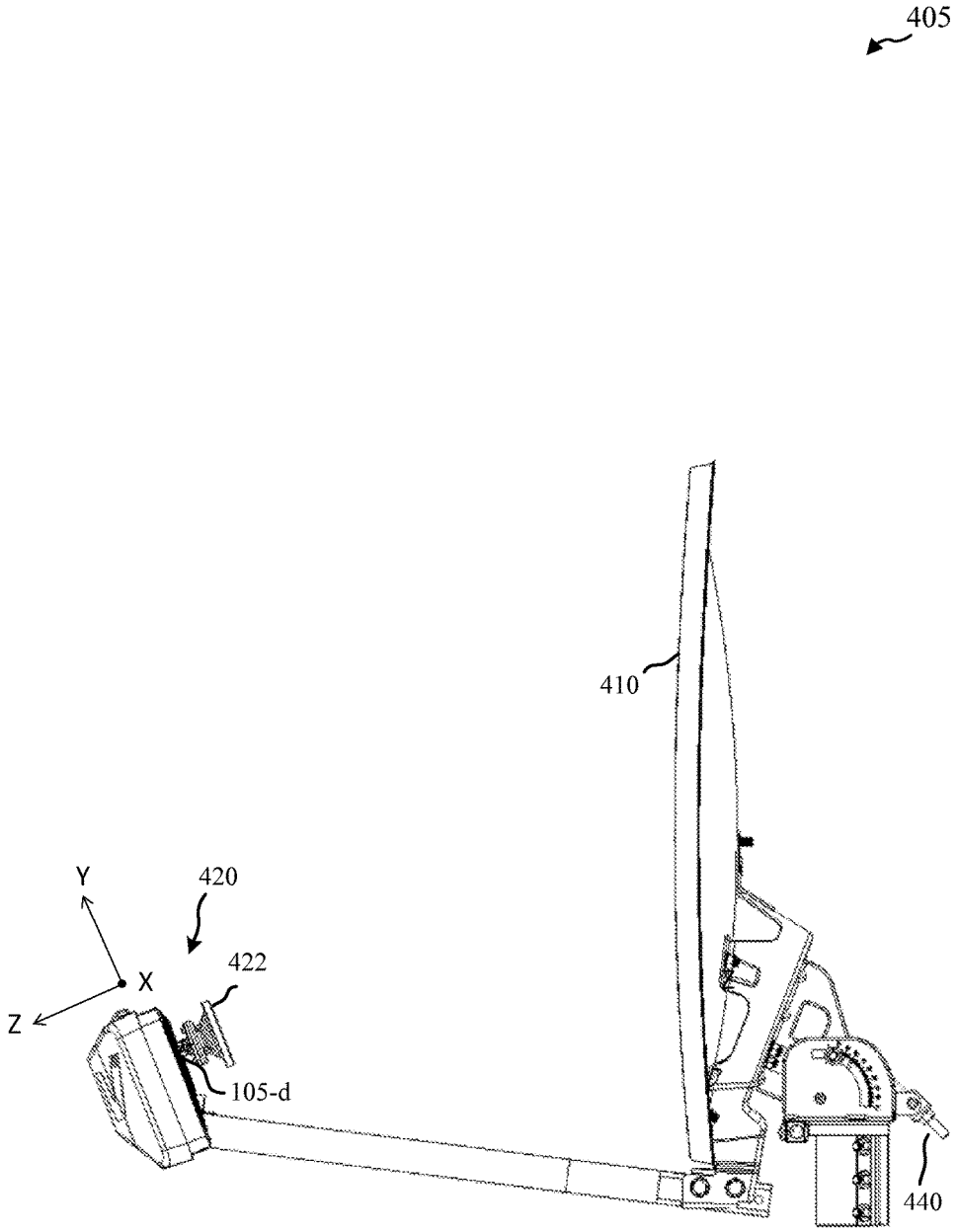
FIG. 4 shows a side view of a satellite antenna implementing a waveguide device in accordance with various aspects of the disclosure.

FIG. 4 shows a side view of a satellite antenna 405 implementing a waveguide device in accordance with various aspects of the disclosure. The satellite antenna 405 may be part of a satellite communication system, for example. The satellite antenna 405 may include a main reflector 410 (e.g., dish) and a satellite communication assembly 420 (e.g., a feed assembly subsystem). The satellite communication assembly 420 includes a waveguide device 105-*d*, which may additionally be coupled with a feed horn assembly 422 (e.g., an antenna element). The waveguide device 105-*d* may be an example of aspects of waveguide devices 105 as described with reference to FIGS. 1A, 1B, 2A, 2B, or 3A-3C. The satellite communication assembly 420 may process signals transmitted by and/or received at the satellite antenna 405. In some examples, the satellite communication assembly 420 may be a transmit and receive integrated assembly (TRIA), which may be coupled with a subscriber terminal via an electrical feed 440 (e.g., a cable).

As illustrated, the satellite communication assembly 420 may have the feed horn assembly 422 opening toward the reflector 410. Electromagnetic signals may be transmitted by and received at the satellite communication assembly 420, with electromagnetic signals reflected by the main reflector 410 from/to the satellite communication assembly 420. In some examples, the satellite communication assembly 420 may further include a sub-reflector. In such examples, electromagnetic signals may be transmitted by and received at the satellite communication assembly 420 via downlink and uplink beams reflected by the sub-reflector and the main reflector 410.

The waveguide device 105-*d* may be used to transmit a first component signal from satellite antenna 405 using a first polarization (e.g., RHCP, etc.) by exciting the corresponding divided waveguide of the waveguide device 105-*d*. The waveguide may also be used to transmit a second component signal from satellite antenna 405 using a second polarization orthogonal to the first polarization (e.g., LHCP, etc.) by exciting a different corresponding divided waveguide of the waveguide device 105-*d*. Additionally or alternatively, the waveguide device may be used to transmit a combined signal (e.g., linearly polarized signal) by excitation of two component signals in the divided waveguides having an appropriate phase offset.

Similarly, when a signal wave is received by satellite antenna 405, the waveguide device 105-*d* directs the energy of the received signal with a particular basis polarization to the corresponding divided waveguide. In some examples the satellite antenna may receive a combined signal (e.g., linearly polarized signal) and separate the combined signal into two component signals in the divided waveguides, which may be phase adjusted and processed to recover the combined signal. The satellite antenna 405 may be used for receiving communication signals from a satellite, transmitting communication signals to the satellite, or bi-directional communication with the satellite (transmitting and receiving communication signals).

In some examples, the satellite antenna 405 may transmit energy using a first polarization and receive energy of a second (e.g., orthogonal) polarization concurrently. In such an example, the waveguide device 105-*d* may be used to transmit a first component signal from satellite antenna 405 using a first polarization (e.g., RHCP, etc.) by exciting the corresponding divided waveguide of the waveguide device. Concurrently, the satellite antenna can receive a signal having a component signal with a second polarization (e.g., LHCP, etc.), where the second polarization is orthogonal to the first polarization. The waveguide device 105-*d* can direct the energy of the received component signal to the corresponding waveguide.

In various examples the satellite communication assembly 420 can be used to receive and/or transmit single-band, dual-band, and/or multi-band signals. For instance, in some examples signals received and/or transmitted by the satellite communication assembly 420 may be characterized by multiple carrier frequencies in a frequency range of 17.5 to 31 GHz. In such examples, the performance of the waveguide device 105-*d* can be improved by including various septum features as described above.

In particular, waveguide device 105-*d* may include one or more septum features such as a ridge 155. Various parameters of each ridge 155 (e.g., number, location, shape, size, spacing, etc.) may be determined according to a particular design implementation. Each ridge adds degrees of freedom to the design of waveguide device 105-*d*, which may help with performance optimization and may increase the achievable performance. For example, the addition of one or more ridges 155 may allow designs to increase bandwidth margins, which may improve robustness to dimensional variations that may result from various manufacturing processes. This may be beneficial, for example, in relatively high volume applications (e.g., where molding or casting may be employed) to achieve increased yields. Furthermore, an increased bandwidth margin may, for instance, improve the ability to design, manufacture, and/or operate a septum polarizer configured to convert the polarization of signals at more than one carrier signal frequency.

Figure 5:
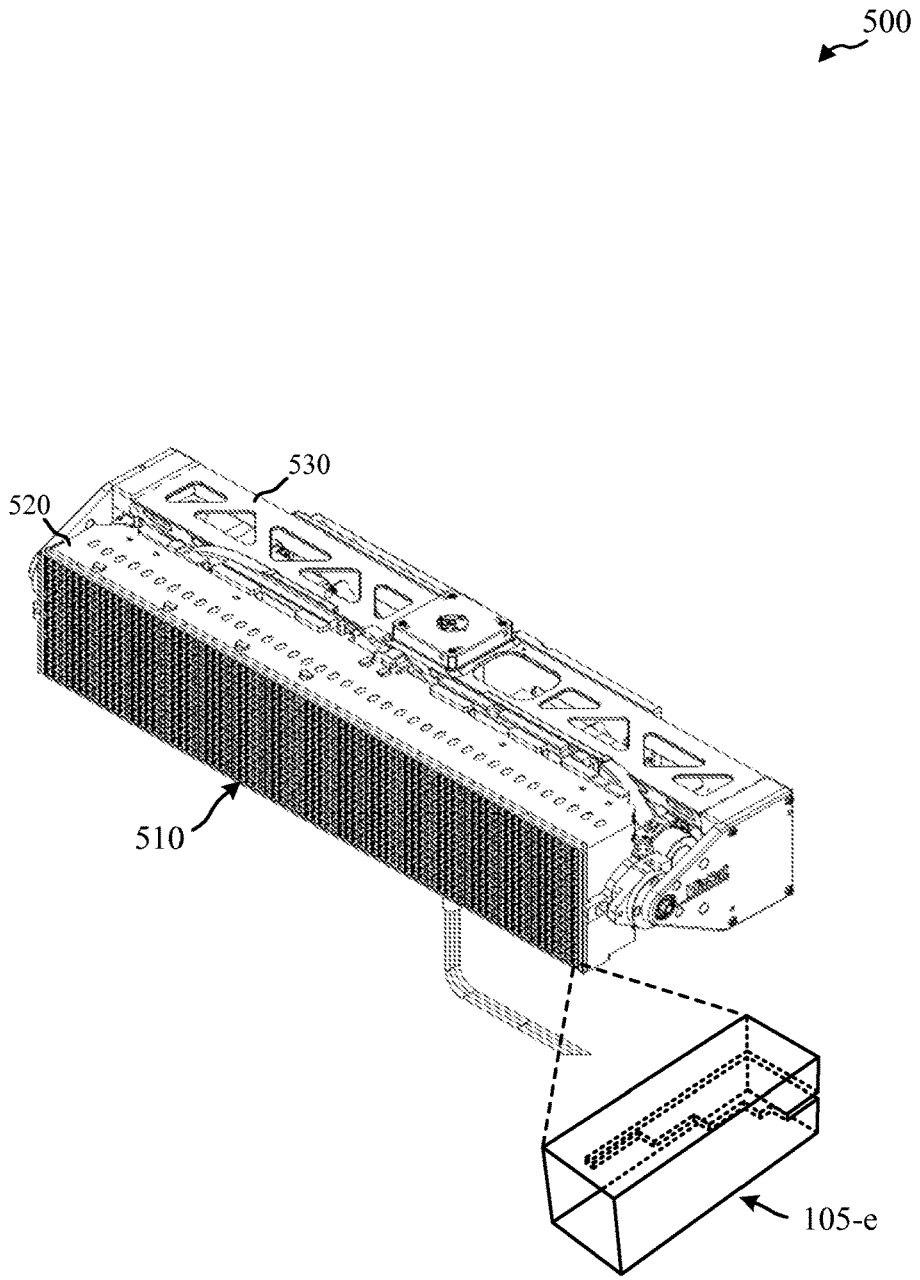
FIG. 5 shows a view of an antenna assembly implementing a waveguide device in accordance with various aspects of the present disclosure.

FIG. 5 shows a view of an antenna assembly 500 implementing a waveguide device in accordance with various aspects of the present disclosure. As shown in FIG. 5, the antenna assembly 500 includes an antenna 510 (e.g., a dual-polarized antenna) and an antenna positioner 530. The antenna positioner 530 may include various components (e.g., motors, gearboxes, sensors, etc.) that may be used to point the antenna 510 at a satellite during operation (e.g., actively tracking). The antenna 510 may operate in the International Telecommunications Union (ITU) Ku, K, or Ka-bands, for example from approximately 17 to 31 GigaHertz (GHz). Alternatively, the antenna 510 may operate in other frequency bands such as C-band, X-band, S-band, L-band, and the like.

The antenna 510 may include a beam forming network 520 and/or a polarization control network (not shown) to provide a planar horn antenna aperture. The polarization control network may combine signals corresponding to the divided waveguides, for example as described in U.S. patent application Ser. No. 14/754,904 entitled "Systems and Methods for Polarization Control," which is incorporated by reference herein. The beam forming network 520 may include multiple antenna elements. One or more antenna elements of the beam forming network 520 may be associated with a waveguide device 105-*e* for polarization combining/dividing. The waveguide device 105-*e* may be an example of the waveguide devices 105 described with reference to FIGS. 1A, 1B, 2A, 2B, or 3A-3C. The waveguide device 105-*e* may include a polarizer section 120 (e.g., a septum 150) for dual-polarization operation.

The beam forming network 520 may include one or more waveguide combiner/divider networks connecting divided waveguide ports of the waveguide devices 105-*e* with common network ports associated with each basis polarization. For instance, in some examples the beam forming network 520 may include a waveguide feed network comprising one or more waveguide junctions that combine/divide signals between the common network port and corresponding divided waveguides from multiple waveguide devices 105-*e*. In other examples, the beam forming network 520 may include an electrical feed network comprising one or more circuits that electrically couple with corresponding divided waveguides, such as a micro strip feed network. Additionally or alternatively, certain divided waveguides from one or more waveguide devices 105-*e* of the beam forming network 520 may be configured to operate independently from other waveguide devices 105-*e* of the beam forming network 520 (e.g., separate transmission and/or receive circuits, etc.).

In various examples of an antenna, a plurality of waveguide devices 105-*e* may be arranged in an array. For instance, as illustrated in the present example, a plurality of waveguide devices 105-*e* are arranged in a rectangular array, where "rectangular" refers to the shape of the area occupied by the plurality of waveguide devices 105-*e* in a plane orthogonal to a central axis of a waveguide device, and/or the boresight of the antenna 510. Other shapes of an array may include a square, a circle, an ellipse, a polygon, or any other shape suitable for an array of waveguide devices 105-*e*. Additionally or alternatively, an array may refer to a grid array, where waveguide devices 105-*e* may be aligned in both rows and columns. alternatively, an array may refer to a transversely staggered array, where waveguide devices may be aligned in one transverse direction, and staggered in another transverse direction (e.g., aligned in a column direction, and staggered in a row direction, or vice versa), where transverse refers to the direction orthogonal to a central axis of a waveguide device 105-*e* and/or the principal axis of the antenna 510. Alternatively or additionally, an array may refer to an axially staggered array, where waveguide devices 105-*e* may not all be aligned in an axial direction, where axial refers to a direction along the central axis of a waveguide device 105-*e* and/or a principal axis of the antenna 510.

The waveguide devices 105-*e* may be used to transmit a first component signal from antenna 510 using a first polarization (e.g., RHCP, etc.) by exciting the corresponding divided waveguides of the waveguide devices 105-*e*. The waveguide devices 105-*e* may also be used to transmit a second component signal from antenna 510 using a second polarization orthogonal to the first polarization (e.g., LHCP, etc.) by exciting different corresponding divided waveguides of the waveguide devices 105-*e*. Additionally or alternatively, the waveguide devices 105-*e* may be used to transmit a combined signal (e.g., linearly polarized signal) by excitation of two component signals in the divided waveguides having an appropriate phase offset.

Similarly, when a signal wave is received by antenna 510, the waveguide devices 105-*e* direct the energy of the received signal with a particular basis polarization to the corresponding divided waveguides. In some examples the satellite antenna may receive a combined signal (e.g., linearly polarized signal) and separate the combined signal into two component signals in the divided waveguides, which may be phase adjusted and processed to recover the combined signal. The antenna 510 may be used for receiving communication signals from a satellite, transmitting communication signals to the satellite , or bi-directional communication with the satellite (transmitting and receiving communication signals).

In some examples, the antenna 510 may transmit energy using a first polarization and receive energy of a second (e.g., orthogonal) polarization concurrently. In such an example, the waveguide devices 105-*e* may be used to transmit a first component signal from antenna 510 using a first polarization (e.g., RHCP, etc.) by exciting the corresponding divided waveguides of the waveguide devices 105-*e*. Concurrently, the satellite antenna can receive a signal having a component signal with a second polarization (e.g., LHCP, etc.), where the second polarization is orthogonal to the first polarization. The waveguide devices 105-*e* can direct the energy of the received component signal to the corresponding waveguide.

In various examples the satellite communication assembly 500 can be used to receive and/or transmit single-band, dual-band, and/or multi-band signals. For instance, in some examples signals received and/or transmitted by the satellite communication assembly 500 may be characterized by multiple carrier frequencies in a frequency range of 17.5 to 31 GHz. In such examples, the performance of the waveguide device 105-*e* can be improved by including various septum features as described above.

In particular, a waveguide device 105-*e* may include one or more septum features such as a ridge 155. Various parameters of each ridge 155 (e.g., number, location, shape, size, spacing, etc.) may be determined according to a particular design implementation. Each ridge adds degrees of freedom to the design of a waveguide device, which may help with performance optimization and may increase the achievable performance. For example, the addition of one or more ridges may allow designs to increase bandwidth margins, which may improve robustness to dimensional variations that may result from various manufacturing processes. This may be beneficial, for example, in relatively high volume applications (e.g., where molding or casting may be employed) to achieve increased yields. Furthermore, an increased bandwidth margin may, for instance, improve the ability to design, manufacture, and/or operate a septum polarizer configured to convert the polarization of signals at more than one carrier signal frequency.

Figure 6:
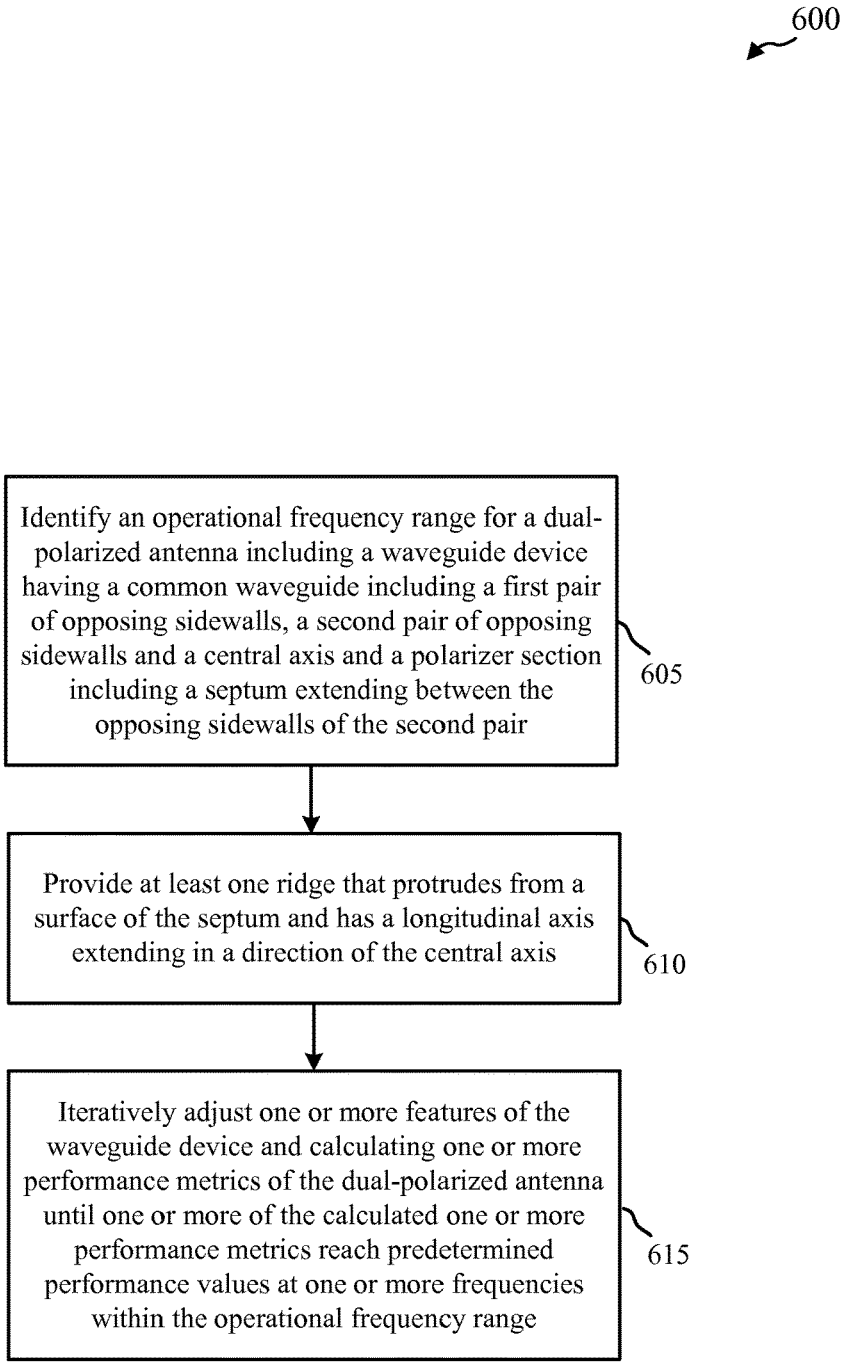
FIG. 6 shows a method for designing a waveguide device having at least one sidewall feature in accordance with various aspects of the present disclosure.

FIG. 6 shows a method 600 for designing a waveguide device having at least one septum feature in accordance with various aspects of the present disclosure. The method 600 may be used, for example, to design a waveguide device for a dual-polarized antenna with a desired operational frequency range. The method 600 may be used to iteratively select the number, shape(s), dimensions, and relative positions of one or more septum features for the waveguide devices 105 of FIGS. 1A, 1B, 2A, 2B, 3A, 3B, 3C, 4, and/or 5.

Method 600 may begin at step 605 where an operational frequency range may be identified for a dual-polarized antenna including a waveguide device having a common waveguide including a first set of opposing sidewalls and a second set of opposing sidewalls and a polarizer section including a septum extending between the opposing sidewalls of the second set. The operational frequency range may include multiple discontinuous frequency segments (e.g., dual band operation, etc.).

At block 610, at least one septum feature may be provided within the polarizer section on at least one surface of the septum. The at least one septum feature may include aspects of the ridges 155 discussed above with reference to FIGS. 1A, 1B, 2A, 2B, or 3A-3C.

At block 615, one or more features of the waveguide device may be iteratively adjusted and one or more performance metrics of the dual-polarized antenna may be calculated until one or more of the calculated one or more performance metrics reach predetermined performance values at one or more frequencies within the operational frequency range. For example, the one or more performance metrics may be calculated at each of a plurality of frequencies within the operational frequency range, and the one or more features of the waveguide device may be adjusted until the one or more of the calculated one or more performance metrics reach the predetermined performance values at each of the plurality of frequencies.

The performance metrics may include, for example, axial ratio, port isolation, return loss, or higher order mode suppression. The one or more features of the waveguide device may include the cross-section of the common waveguide or the number, shape(s), dimensions, or relative positions of one or more septum features.

The detailed description set forth above in connection with the appended drawings describes exemplary embodiments and does not represent the only embodiments that may be implemented or that are within the scope of the claims. The term "example" used throughout this description means "serving as an example, instance, or illustration," and not "preferred" or "advantageous over other embodiments." The detailed description includes specific details for the purpose of providing an understanding of the described techniques. These techniques, however, may be practiced without these specific details. In some instances, well-known structures and devices are shown in block diagram form in order to avoid obscuring the concepts of the described embodiments.

Information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The aspects described herein may be implemented in various ways, with different materials, features, shapes, sizes, or the like. Other examples and implementations are within the scope of the disclosure and appended claims. Features implementing functions may also be physically located at various positions, including being distributed such that portions of functions are implemented at different physical locations. Also, as used herein, including in the claims, "or" as used in a list of items (for example, a list of items prefaced by a phrase such as "at least one of" or "one or more of") indicates a disjunctive list such that, for example, a list of "at least one of A, B, or C" means A or B or C or AB or AC or BC or ABC (i.e., A and B and C).

As used in the description herein, the term "parallel" is not intended to suggest a limitation to precise geometric parallelism. For instance, the term "parallel" as used in the present disclosure is intended to include typical deviations from geometric parallelism relating to such considerations as, for example, manufacturing and assembly tolerances. Furthermore, certain manufacturing process such as molding or casting may require positive or negative drafting, edge chamfers and/or fillets, or other features to facilitate any of the manufacturing, assembly, or operation of various components, in which case certain surfaces may not be geometrically parallel, but may be parallel in the context of the present disclosure.

Similarly, as used in the description herein, the terms "orthogonal" and "perpendicular", when used to describe geometric relationships, are not intended to suggest a limitation to precise geometric perpendicularity. For instance, the terms "orthogonal" and "perpendicular" as used in the present disclosure are intended to include typical deviations from geometric perpendicularity relating to such considerations as, for example, manufacturing and assembly tolerances. Furthermore, certain manufacturing process such as molding or casting may require positive or negative drafting, edge chamfers and/or fillets, or other features to facilitate any of the manufacturing, assembly, or operation of various components, in which case certain surfaces may not be geometrically perpendicular, but may be perpendicular in the context of the present disclosure.

As used in the description herein, the term "orthogonal," when used to describe electromagnetic polarizations, are meant to distinguish two polarizations that are separable. For instance, two linear polarizations that have unit vector directions that are separated by 90 degrees can be considered orthogonal. For circular polarizations, two polarizations are considered orthogonal when they share a direction of propagation, but are rotating in opposite directions.

The previous description of the disclosure is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not to be limited to the examples and designs described herein but is to be accorded the widest scope consistent with the principles and novel features disclosed herein.

What is claimed is:

1. A waveguide device, comprising:

a common waveguide section;

a divided waveguide section having a first divided waveguide associated with a first basis polarization and a second divided waveguide associated with a second basis polarization; and a polarizer section coupled between the common waveguide section and the divided waveguide section, the polarizer section comprising a central axis in a direction between the common waveguide section and the divided waveguide section, a first set of opposing sidewalls, a second set of opposing sidewalls, and a septum extending between the opposing sidewalls of the first set and forming a boundary between the first and second divided waveguides, the septum including:

first and second septum surfaces parallel to the central axis and extending between the opposing sidewalls of the first set; and a ridge that protrudes from at least one of the first or second septum surfaces, the ridge having a longitudinal axis extending in a direction of the central axis.

2. The waveguide device of claim 1, wherein the septum comprises a plurality of ridges including the ridge, each ridge from the plurality of ridges protruding from at least one of the first and second septum surfaces.

3. The waveguide device of claim 2, wherein the plurality of ridges comprises at least two ridges of different sizes.

4. The waveguide device of claim 1, wherein:

the ridge is a first ridge protruding from the first septum surface; and the septum further comprises a second ridge protruding from the second septum surface.

5. The waveguide device of claim 4, wherein the first ridge and the second ridge are aligned with one another along the central axis.

6. The waveguide device of claim 1, wherein the septum comprises a plurality of stepped surfaces perpendicular to the first and second septum surfaces and parallel with the central axis.

7. The waveguide device of claim 6, wherein the septum comprises a plurality of ridges including the ridge, each ridge of the plurality of ridges adjacent to a respective stepped surface of the plurality of stepped surfaces of the septum.

8. The waveguide device of claim 7, wherein:

each of the plurality of ridges has a height normal to the at least one of the first and second septum surfaces and a width at the at least one of the first and second septum surfaces transverse to the longitudinal axis of the ridge; and at least two of the plurality of ridges have at least one of the height or the width different from one another.

9. The waveguide device of claim 7, wherein each of the plurality of ridges has a length along the longitudinal axis extending between respective adjacent steps of the septum.

10. The waveguide device of claim 1, wherein:

the ridge has a height normal to the at least one of the first and second septum surfaces and a width at the at least one of the first and second septum surfaces transverse to the longitudinal axis of the ridge; and a cross-sectional dimension of the polarizer section is at least five times greater than at least one of the height or the width of the ridge.

11. The waveguide device of claim 10, wherein the cross-sectional dimension of the polarizer section is at least ten times greater than the at least one of the height or the width of the ridge.

12. The waveguide device of claim 1, wherein:

the ridge has a height normal to the at least one of the first and second septum surfaces and a width along the at least one of the first and second septum surfaces transverse to the longitudinal axis of the ridge; and at least one of the height or the width of the ridge varies along the longitudinal axis of the ridge.

13. The waveguide device of claim 1, wherein:

the ridge extends greater than half of a length of the septum in the direction of the central axis.

14. The waveguide device of claim 1, wherein a cross-sectional shape of the ridge taken orthogonal to the central axis is square or rectangular.

15. The waveguide device of claim 1, wherein the ridge comprises a material that is different from a material of the septum.

16. The waveguide device of claim 1, wherein the ridge is coincident with one of the opposing sidewalls of the first set.

17. The waveguide device of claim 16, wherein the ridge includes a plurality of ridge sections, each ridge section having a cross-sectional shape taken orthogonal to the central axis, and at least two of the cross-sectional shapes having a different size from one another.

18. The waveguide device of claim 17, wherein the septum comprises a plurality of stepped surfaces parallel with the first set of opposing sidewalls.

19. The waveguide device of claim 18, wherein each ridge section from the plurality of ridge sections are aligned with a respective one of the plurality of stepped surfaces of the septum in the direction of the central axis.

20. The waveguide device of claim 18, wherein a number of the plurality of stepped surfaces of the septum is different than a number of the plurality of ridge sections.

21. The waveguide device of claim 1, further comprising:

an antenna element coupled with the common waveguide section.

22. The waveguide device of claim 21, wherein the first basis polarization and the second basis polarization correspond to orthogonal basis polarizations of the antenna element.

23. A waveguide device, comprising:

a plurality of polarizers, each polarizer having a common waveguide section, a divided waveguide section with a first divided waveguide associated with a first basis polarization and a second divided waveguide associated with a second basis polarization, and a polarizer section coupled between the common waveguide section of the polarizer;

the polarizer section of each polarizer from the plurality of polarizers comprising a central axis in a direction between the common waveguide section of the polarizer and the divided waveguide section of the polarizer, a first set of opposing sidewalls, a second set of opposing sidewalls, and a septum extending between the opposing sidewalls of the first set and forming a boundary between the first and second divided waveguides of the polarizer, the septum of each polarizer from the plurality of polarizers including:

first and second septum surfaces parallel to the central axis of the polarizer; and a ridge that protrudes from at least one of the first or second septum surfaces.

24. The waveguide device of claim 23, further comprising:

a plurality of antenna elements coupled with respective polarizers from the plurality of polarizers.

25. The waveguide device of claim 24, wherein the plurality of polarizers are configured in any of a grid array, a transversely staggered array, an axially staggered array, a rectangular array, a square array, a round array, or a circular array.

* * * * *